US007754057B2

(12) United States Patent
O'Leary et al.

(10) Patent No.: US 7,754,057 B2
(45) Date of Patent: Jul. 13, 2010

(54) CHLORINE DIOXIDE SOLUTION GENERATOR

(75) Inventors: Timothy J. O'Leary, Huntington Beach, CA (US); Jerry J. Kaczur, North Miami Beach, FL (US); Chenniah Nanjundiah, San Diego, CA (US)

(73) Assignee: Pureline Treatment Systems, LLC, Lake Forest, CA (US)

( * ) Notice: Subject to any disclaimer, the term of this patent is extended or adjusted under 35 U.S.C. 154(b) by 758 days.

(21) Appl. No.: 10/902,681

(22) Filed: Jul. 29, 2004

(65) Prior Publication Data

US 2006/0021872 A1 Feb. 2, 2006

(51) Int. Cl.
*C25B 9/00* (2006.01)
*C25B 1/26* (2006.01)

(52) U.S. Cl. ..... 204/233; 204/234; 204/263; 205/499

(58) Field of Classification Search ..... 204/337
See application file for complete search history.

(56) References Cited

U.S. PATENT DOCUMENTS 3,771,926 A * 11/1973 Pardieck ..... 415/176
4,276,262 A 6/1981 Cowley
4,336,228 A 6/1982 Cowley
4,486,399 A * 12/1984 Lobley ..... 423/478
4,590,057 A * 5/1986 Hicks ..... 423/477
4,680,119 A * 7/1987 Franklin, Jr. ..... 210/512.1
4,761,208 A * 8/1988 Gram et al. ..... 210/748
4,798,715 A * 1/1989 Hardee et al. ..... 423/478
4,989,160 A * 1/1991 Garrett et al. ..... 700/282
5,006,326 A 4/1991 Mayurnik et al.
5,322,598 A * 6/1994 Cawlfield et al. ..... 205/474
5,458,858 A * 10/1995 Dawkins ..... 422/234
5,711,865 A * 1/1998 Caesar ..... 205/628
5,792,441 A 8/1998 Paleologou et al.
5,965,004 A * 10/1999 Cowley et al. ..... 205/499
5,968,454 A 10/1999 Deacon et al.
6,051,135 A 4/2000 Lee et al.
6,171,558 B1 1/2001 Simpson
6,274,009 B1 8/2001 Krafton et al.
6,468,479 B1 10/2002 Mason et al.
6,823,878 B1 * 11/2004 Gadini ..... 134/58 D
2002/0079235 A1 * 6/2002 Molter et al. ..... 205/746
2005/0061741 A1 3/2005 Mainz et al.

FOREIGN PATENT DOCUMENTS

WO WO-02/14216 A 2/2002

* cited by examiner

*Primary Examiner*—Harry D Wilkins, III
(74) *Attorney, Agent, or Firm*—McAndrews, Held & Malloy, Ltd.

(57) ABSTRACT

A chlorine dioxide solution generator, which injects a chlorine dioxide solution into a pressurized fluid system, including an absorption loop for effecting the dissolution of chlorine dioxide into a liquid stream. The chlorine dioxide gas source can include an anolyte loop and a catholyte loop. The generator avoids or eliminates the introduction of air or other gases that can cause corrosion in the process distribution system.

23 Claims, 4 Drawing Sheets

CHLORINE DIOXIDE SOLUTION GENERATOR

FIELD OF THE INVENTION

The present invention relates to chlorine dioxide generators. More particularly, the present invention relates to a chlorine dioxide generator that produces a chlorine dioxide solution for use in water treatment systems.

BACKGROUND OF THE INVENTION

Chlorine dioxide ($ClO_2$) has many industrial and municipal uses. When produced and handled properly, $ClO_2$ is an effective and powerful biocide, disinfectant and oxidizer.

$ClO_2$ is extensively used in the pulp and paper industry as a bleaching agent, but is gaining further support in such areas as disinfection in municipal water treatment. Other applications can include use as a disinfectant in the food and beverage industries, wastewater treatment, industrial water treatment, cleaning and disinfection of medical wastes, textile bleaching, odor control for the rendering industry, circuit board cleansing in the electronics industry, and uses in the oil and gas industry.

In water treatment applications, $ClO_2$ is primarily used as a disinfectant for surface waters with odor and taste problems. It is an effective biocide at low concentrations and over a wide pH range. $ClO_2$ is desirable because when it reacts with an organism in water, chlorite results, which studies have shown poses no significant adverse risk to human health. The use of chlorine, on the other hand, can result in the creation of chlorinated organic compounds when treating water. Chlorinated compounds are suspected to increase cancer risk.

Producing $ClO_2$ gas for use in a chlorine dioxide water treatment process is desirable because there is greater assurance of $ClO_2$ purity when in the gas phase. $ClO_2$ is, however, unstable in the gas phase and will readily undergo decomposition into chlorine gas ($Cl_2$), oxygen gas ($O_2$), and heat. The high reactivity of $ClO_2$ generally requires that it be produced and used at the same location. $ClO_2$ is, however, soluble and stable in an aqueous solution.

$ClO_2$ can be prepared by a number of ways, generally through a reaction involving either chlorite ($ClO_2^-$) or chlorate ($ClO_3^-$) solutions. The $ClO_2$ created through such a reaction is often refined to generate $ClO_2$ gas for use in the water treatment process. The $ClO_2$ gas is then typically educed into the water selected for treatment. Eduction occurs where the $ClO_2$ gas, in combination with air, is mixed with the water selected for treatment.

For many water treatment systems, the eduction process satisfactorily introduces $ClO_2$ gas directly into the process water. Problems can occur, however, with such water treatment systems. One problem can occur when air is simultaneously introduced into a water system while educing the $ClO_2$ gas. A tremendous corrosion potential results because oxygen from the air is added into the system. Another problem can occur when introducing $ClO_2$ gas into a pressurized water system. Treating water in pressurized systems can be difficult when using educed $ClO_2$ gas, since high-pressure booster pumps may be needed along with high-performance eductors. This not only increases cost, but also raises maintenance concerns, since high-performance eduction systems can be unreliable as operating pressures near 30 to 50 pounds per square inch (psi) or above (206.8 to 344.7 kilopascal (kPa) or above).

A need exists for a reliable chlorine dioxide generator that allows $ClO_2$ to be introduced into pressurized water systems.

Furthermore, a need exists for a chlorine dioxide generator that reduces or minimizes the potential for corrosion problems that can be associated with water systems.

SUMMARY OF THE INVENTION

A chlorine dioxide solution generator comprises a chlorine dioxide gas source; and an absorption loop for effecting the dissolution of chlorine dioxide into a liquid stream. The absorption loop is fluidly connected to the chlorine dioxide gas source.

In a preferred embodiment of the chlorine dioxide solution generator, the absorption loop comprises a gas transfer device for directing a chlorine dioxide gas stream from the chlorine dioxide gas source to a chlorine dioxide absorber tank. In another embodiment, the absorber tank comprises an upper portion and a lower portion, the chlorine dioxide gas and a process water entering the absorber tank at the lower portion of the absorber tank, at least some of the chlorine dioxide gas absorbing into solution with the process water to form a chlorine dioxide solution. In another embodiment, the chlorine dioxide solution exits the absorber tank at the upper portion of the absorber tank. In another embodiment, a residual of the chlorine dioxide gas exits the upper portion of the absorber tank and recirculates into a chlorine dioxide gas generator loop.

In a preferred embodiment, the chlorine dioxide solution from the chlorine dioxide solution generator is substantially free of reactant feedstock constituents. In another embodiment, the chlorine dioxide solution is substantially neutral in pH and substantially free from reaction byproducts. In another embodiment, the process water for the chlorine dioxide solution generator is substantially demineralized. Alternatively, the process water of the chlorine dioxide solution generator is produced by reverse osmosis.

In a preferred embodiment, the chlorine dioxide solution exits the chlorine dioxide solution generator absorber tank via a process delivery pump. In another embodiment, at least one flow switch associated with the absorber tank controls inflow of the process water to the chlorine dioxide solution generator. In another embodiment, at least one flow switch on the absorber tank controls gas flow through the absorber.

In a preferred embodiment, the chlorine dioxide gas source of the chlorine dioxide solution generator comprises an anolyte loop and a catholyte loop, with the catholyte loop fluidly connected to the anolyte loop via a common electrochemical component. The anolyte loop comprises a reactant feedstock stream; at least one electrochemical cell fluidly connected to the feedstock stream, the electrochemical cell system having a positive end and a negative end, the reactant feedstock stream directed through the at least one electrochemical cell to produce a chlorine dioxide solution, and a stripper column. The chlorine dioxide solution is directed from the positive end of the at least one electrochemical cell into the stripper column. The stripper column produces at least one of a chlorine dioxide gas stream and excess chlorine dioxide solution, and the excess chlorine dioxide solution is directed out of the stripper column and recirculated with the reactant feedstock stream into the at least one electrochemical cell, with the chlorine dioxide gas stream exiting the stripper column directed to the absorption loop. In another embodiment, the reactant feedstock is a chlorite solution having a chlorite concentration of up to the maximum amount capable of being dissolved in the reactant feedstock. In another embodiment, sodium chlorite is present in the reactant feedstock in a concentration between 5 percent and 25 percent by weight.

In a preferred embodiment, the catholyte loop of the chlorine dioxide solution generator extends from the negative end of at least one electrochemical cell. The catholyte loop comprises a demineralized water feed source fluidly connected to the negative end of the at least one electrochemical cell, with the demineralized water feed source having a positive ionic constituent imparted thereto from a reaction of a reactant feedstock in the at least one electrochemical cell to produce an ionic solution byproduct, and a byproduct tank. The ionic solution byproduct is directed from the negative end of the at least one electrochemical cell to the byproduct tank, with the ionic solution byproduct directed out of the byproduct tank and recirculated with the demineralized water into the at least one electrochemical cell. In another embodiment, the reaction of the reactant feedstock produces a byproduct gas, with the byproduct gas directed from the negative end of the at least one electrochemical cell. The byproduct gas is diluted with ambient air and exhausted from the generator. In another embodiment, the byproduct solution of the chlorine dioxide solution generator in the byproduct tank is diluted.

In a preferred embodiment, the chlorine dioxide gas source and the absorption loop of the chlorine dioxide solution generator operate to allow introduction of a substantially pure chlorine dioxide solution into a pressurized water system. In another embodiment, the absorption loop of the chlorine dioxide solution generator inhibits introduction of air into a pressurized water system.

In a preferred embodiment, the chlorine dioxide solution generator further comprises a programmable logic control system.

In a preferred embodiment, a chlorine dioxide solution generator comprises a chlorine dioxide gas generator loop. The chlorine dioxide solution generator further comprises an absorption loop. The absorption loop is fluidly connected to the chlorine gas generator loop, with the absorption loop comprising a gas transfer pump. The gas transfer pump directs a substantially pure chlorine dioxide gas stream from the chlorine gas generator loop to a chlorine dioxide absorber tank. The absorber tank has an upper portion and a lower portion, with the substantially pure chlorine dioxide gas stream and a process water entering the absorber tank at the lower portion of the absorber tank, with at least some of the substantially pure chlorine dioxide gas absorbing into solution with the process water to form a chlorine dioxide solution. The chlorine dioxide solution exits the absorber tank at the upper portion of the absorber tank, with a residual stream of substantially pure chlorine dioxide gas exiting the upper portion of the absorber tank and circulating back into the chlorine dioxide gas generator loop.

In another embodiment, a chlorine dioxide solution generator comprises an anolyte loop. The anolyte loop comprises a reactant feedstock fluidly connected to at least one electrochemical cell, with the at least one electrochemical cell having a positive end and a negative end. The at least one electrochemical cell produces an output of chlorine dioxide solution from the reactant feedstock stream, with the chlorine dioxide solution directed from the positive end of the at least one electrochemical cell into a stripper column. The stripper column produces at least one of a substantially pure chlorine dioxide gas stream and an excess chlorine dioxide solution, with the excess chlorine dioxide solution circulated with the reactant feedstock into the at least one electrochemical cell. The substantially pure chlorine dioxide gas stream exhausts from the stripper column via a transfer pump. The chlorine dioxide solution generator further comprises a catholyte loop. The catholyte loop is fluidly connected to the negative end of the at least one electrochemical cell. The catholyte loop comprises a demineralized water source, with the demineralized water source connected to the negative end of the at least one electrochemical cell. The demineralized water source has a positive ionic constituent imparted thereto from a reaction of a reactant feedstock in the at least one electrochemical cell to produce an ionic solution byproduct stream. The ionic solution byproduct stream directed from the negative end of the at least one electrochemical cell to a byproduct tank, with the ionic solution byproduct stream circulated with the demineralized water source from the byproduct tank to the at least one electrochemical cell. The chlorine dioxide solution generator further comprises an absorption loop. The absorption loop is fluidly connected to the anolyte loop. The absorption loop comprises the gas transfer pump for directing the substantially pure chlorine dioxide stream from the stripper column to a chlorine dioxide absorber tank. The absorber tank has an upper portion and a lower portion, with the substantially pure chlorine dioxide gas stream and a process water stream entering the absorber tank at the lower portion of the absorber tank, with at least some of the substantially pure chlorine dioxide gas absorbing into solution with the process water stream to form a chlorine dioxide solution. The chlorine dioxide solution exits the absorber tank at the upper portion of the absorber tank, with a residual stream of substantially pure chlorine dioxide gas exiting the upper portion of the absorber tank and circulating into the stripper column of the anolyte loop.

DETAILED DESCRIPTION OF PREFERRED EMBODIMENT(S)

Figure 1:
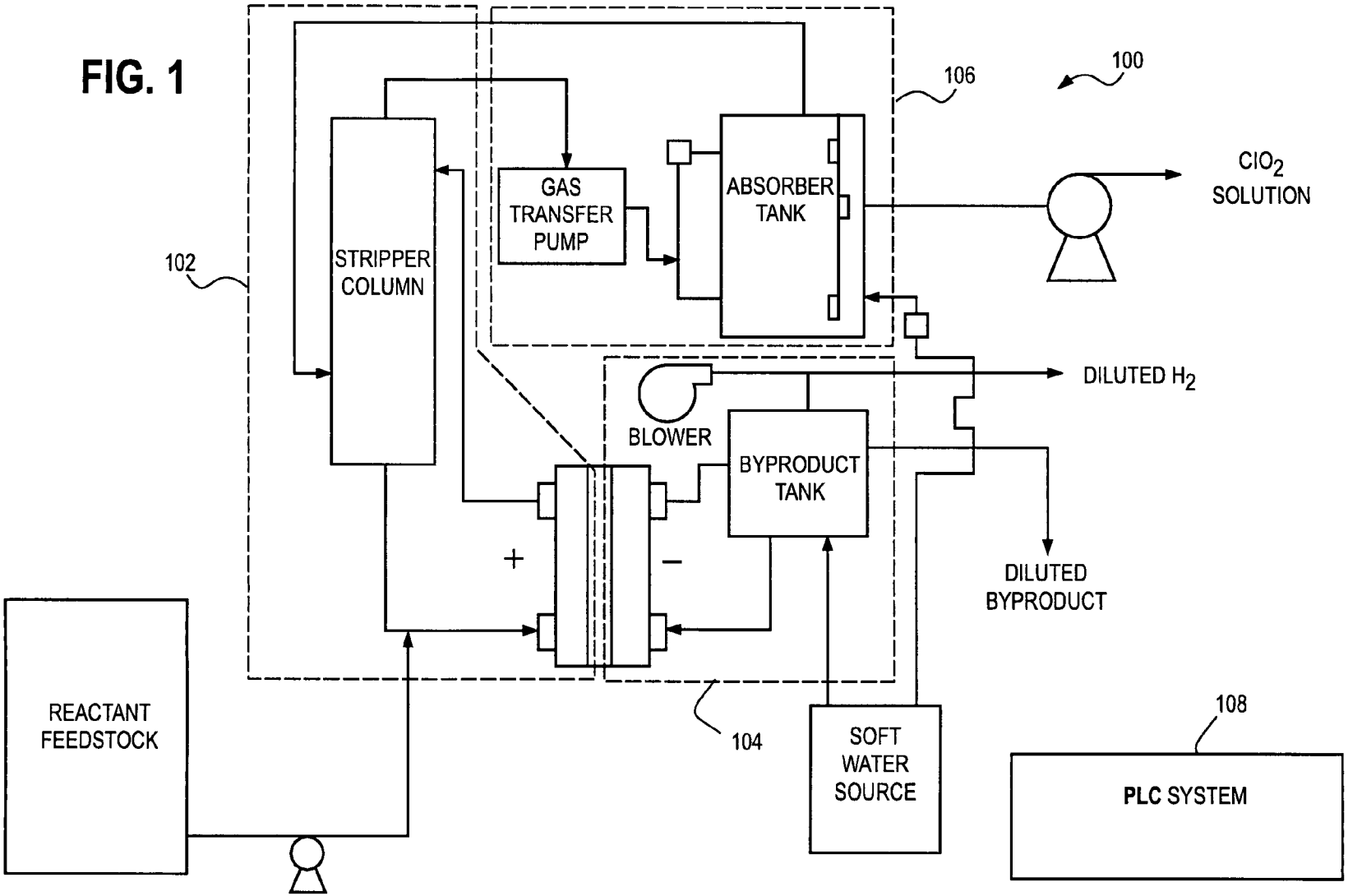
FIG. 1 is a process flow diagram of an embodiment of the present chlorine dioxide solution generator.

FIG. 1 illustrates a process flow diagram of an embodiment of the present chlorine dioxide solution generator 100. The process flow of FIG. 1 consists of three sub-processes including an anolyte loop 102, a catholyte loop 104, and an absorption loop 106. The purpose of the anolyte loop 102 is to produce a chlorine dioxide ($ClO_2$) gas by oxidation of chlorite, and the process can be referred to as a $ClO_2$ gas generator loop. The $ClO_2$ gas generator loop is essentially a $ClO_2$ gas source. Various sources of $ClO_2$ are available and known in the water treatment field. The catholyte loop 104 of the $ClO_2$ gas generator loop produces sodium hydroxide and hydrogen gas by reduction of water. Once the $ClO_2$ gas is produced in the $ClO_2$ gas generator loop, the $ClO_2$ gas is transferred to the absorption loop 106 where the gas is further prepared for water treatment objectives. The process can be operated through a program logic control (PLC) system 108 that can include displays.

In this application, the term "absorb" refers to the process of dissolving or infusing a gaseous constituent into a liquid, optionally using pressure to effect the dissolution or infusion. Here, $ClO_2$ gas, which is produced in the $ClO_2$ gas generator loop, is "absorbed" (that is, dissolved or infused) into an aqueous liquid stream directed through absorption loop 106.

Figure 2:
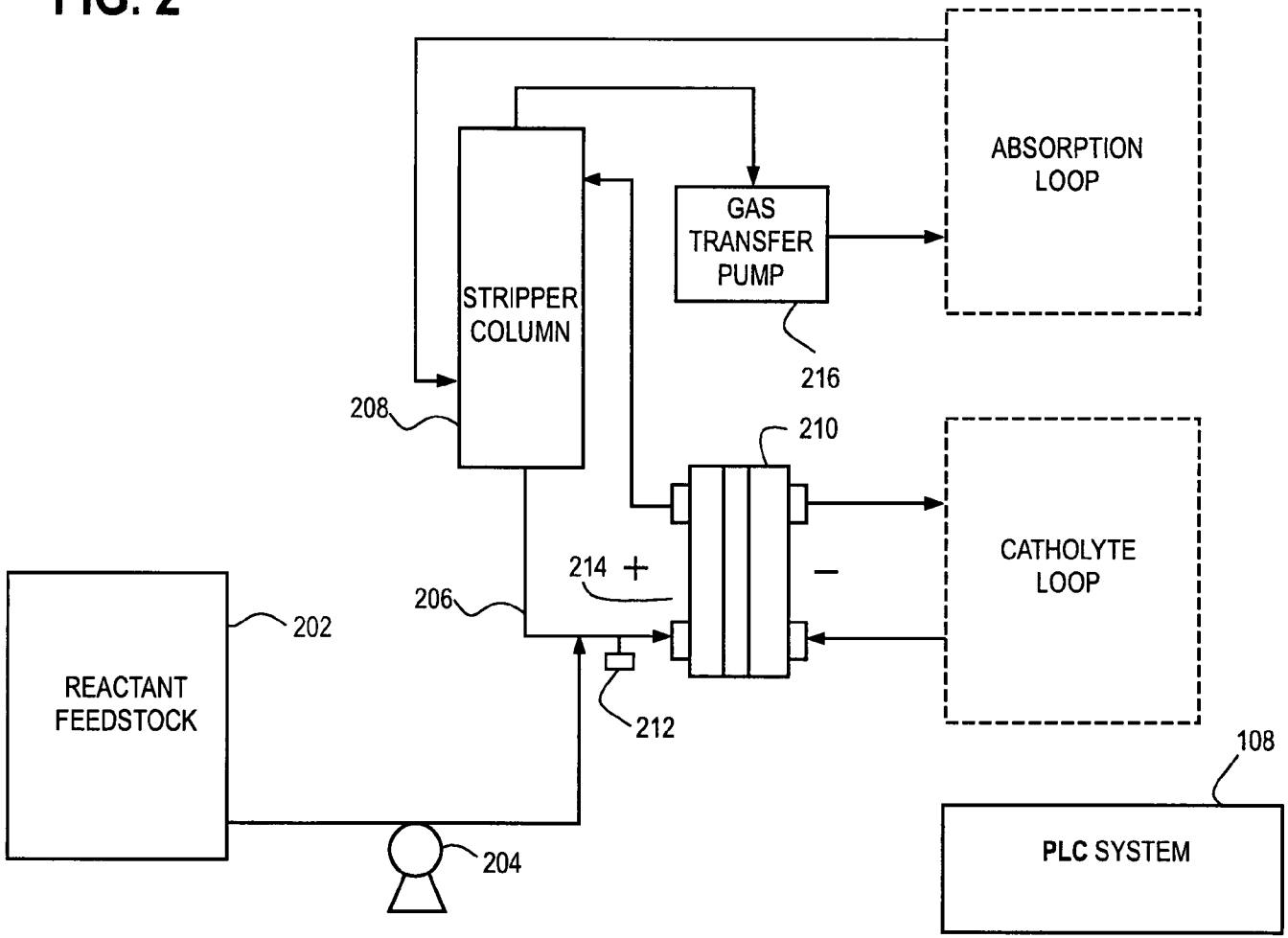
FIG. 2 is a process flow diagram of an anolyte loop of an embodiment of the present chlorine dioxide solution generator.

FIG. 2 illustrates an anolyte loop 102 in an embodiment of the chlorine dioxide solution generator 100. The contribution of the anolyte loop 102 to the $ClO_2$ solution generator is to produce a $ClO_2$ gas that is directed to the absorption loop 106 for further processing. The anolyte loop 102 embodiment presented in FIG. 2 is for a chlorine dioxide gas produced using a reactant feedstock 202. In a preferred embodiment, a 25 percent by weight sodium chlorite ($NaClO_2$) solution can be used as the reactant feedstock 202. However, feedstock concentrations ranging from 0 percent to a maximum solubility (40 percent at 17 degrees Celsius in the embodiment involving $NaCl_2$), or other suitable method of injecting suitable electrolytes, can be employed.

The reactant feedstock 202 is connected to a chemical metering pump 204 which delivers the reactant feedstock 202 to a recirculating connection 206 in the anolyte loop 102. The recirculating connection 206 in the anolyte loop connects a stripper column 208 to an electrochemical cell 210. The delivery of the reactant feedstock 202 can be controlled using the PLC system 108. The PLC system 108 can be used to activate the chemical metering pump 204 according to signals received from a pH sensor 212. The pH sensor is generally located along the recirculating connection 206. A pH setpoint can be established in the PLC system 108 and once this setpoint is reached, the delivery of reactant feedstock 202 may either start or stop.

The reactant feedstock 202 is delivered to a positive end 214 of the electrochemical cell 210 where the reactant feedstock is oxidized to form a $ClO_2$ gas, which is dissolved in an electrolyte solution along with other side products. The $ClO_2$ solution with the side products is directed out of the electrochemical cell 210 to the top of the stripper column 208 where a pure $ClO_2$ is stripped off in a gaseous form from the other side products. Side products or byproducts may include chlorine, chlorates, chlorites and/or oxygen. The pure $ClO_2$ gas is then removed from the stripper column under a vacuum using a gas transfer pump 216, or analogous gas transfer device (such as, for example, a vacuum-based device), where it is delivered to the adsorption loop 106. The remaining solution is collected at the base of the stripper column 208 and recirculated back across the pH sensor 212 where additional reactant feedstock 202 may be added. The process with the reactant feedstock and/or recirculation solution being delivered into the positive end 214 of the electrochemical cell 210 is then repeated.

Modifications to the anolyte loop process can be made that achieve similar results. As an example, an anolyte hold tank can be used in place of a stripper column. In such a case, an inert gas or air can be blown over the surface or through the solution to separate the $ClO_2$ gas from the anolyte. As another example, chlorate can be reduced to produce $ClO_2$ in a cathode loop instead of chlorite. The $ClO_2$ gas would then similarly be transferred to the absorption loop. In a further example, $ClO_2$ can be generated by purely chemical generators and transferred to an absorption loop for further processing.

Figure 3:
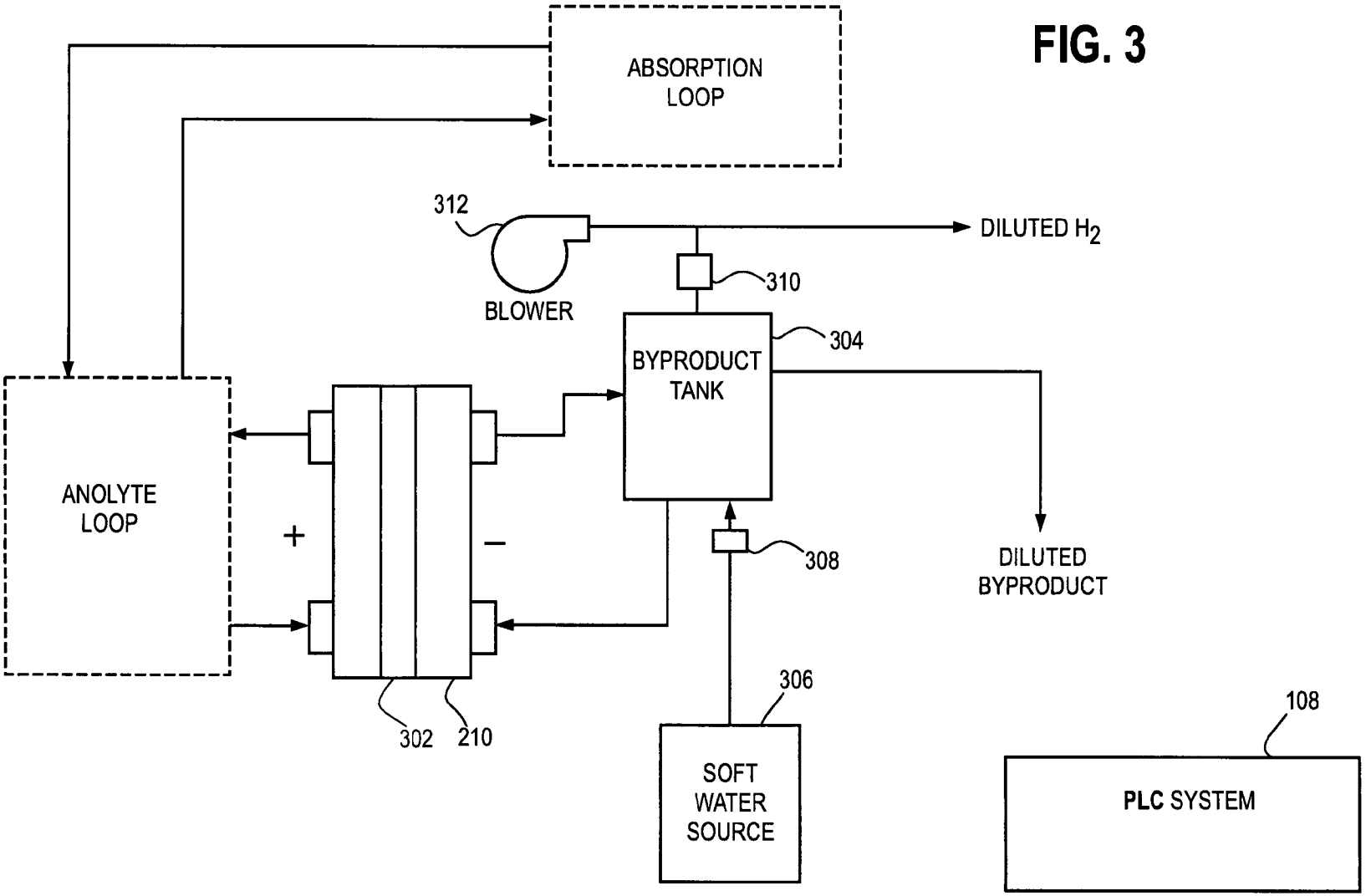
FIG. 3 is a process flow diagram of a catholyte loop of an embodiment of the present chlorine dioxide solution generator.

FIG. 3 illustrates a catholyte loop 104 in an embodiment of a chlorine dioxide solution generator 100. The catholyte loop 104 contributes to the $ClO_2$ solution generator 100 by handling byproducts produced from the electrochemical reaction of the reactant feedstock 202 solution in the anolyte loop 102. As an example, where a sodium chlorite ($NaClO_2$) solution is used as the reactant feedstock 202, sodium ions from the anolyte loop 102 migrate to the catholyte loop 104 through a cationic membrane 302, in the electrochemical cell 210, to maintain charge neutrality. Water in the catholyte is reduced to produce hydroxide and hydrogen ($H_2$) gas. The resulting byproducts in the catholyte loop 104, in the example of a $NaClO_2$ reactant feedstock, are sodium hydroxide (NaOH) and hydrogen gas. The byproducts are directed to a byproduct tank 304.

In an embodiment of the catholyte loop 104 in the example of a $NaClO_2$ reactant feedstock, a soft (that is, demineralized) water source 306 can be used to dilute the byproduct NaOH using a solenoid valve 308 connected between the soft water source 306 and the byproduct tank 304. The solenoid valve 308 can be controlled with the PLC system 108. In a preferred embodiment, the PLC system 108 can use a timing routine that maintains the NaOH concentration in a range of 5 percent to 20 percent. When the byproduct tank 304 reaches a predetermined level above the base of the tank 304, the diluted NaOH byproduct above that level is removed from the catholyte loop 104.

In the example of a $NaClO_2$ reactant feedstock, the catholyte loop 104 self circulates using the lifting properties of the $H_2$ byproduct gas formed during the electrochemical process and a forced water feed from the soft water source 306. The $H_2$ gas rises up in the byproduct tank 304 where there is a hydrogen disengager 310. The $H_2$ gas can be diluted with air in the hydrogen disengager 310 to a concentration of less than 0.5 percent. The diluted $H_2$ gas can be discharged from the catholyte loop 104 and the chlorine dioxide solution generator 100 using a blower 312.

In another embodiment, dilute sodium hydroxide can be fed instead of water to produce concentrated sodium hydroxide. Oxygen or air can also be used as a reductant instead of water to reduce overall operation voltage since oxygen reduces at lower voltage than water.

The reaction of the anolyte loop 102 and catholyte loop 104 in the embodiment illustrated in FIGS. 2 and 3 is represented by the following net chemical equation:

$$2NaClO_{2(aq)}+2H_2O \rightarrow 2ClO_{2(gas)}+2NaOH_{(aq)}+H_{2(gas)}$$

The $NaClO_2$ is provided by the reactant feedstock 202 of the anolyte loop 102. The NaOH and $H_2$ gas are byproducts of the reaction in the catholyte loop 104. The $ClO_2$ solution along with the starting unreacted $NaClO_2$ and other side products are directed to the stripper column for separating into $ClO_2$ gas as part of the anolyte loop 102 process. Chlorite salts other than $NaClO_2$ can be used in the anolyte loop.

Figure 4:
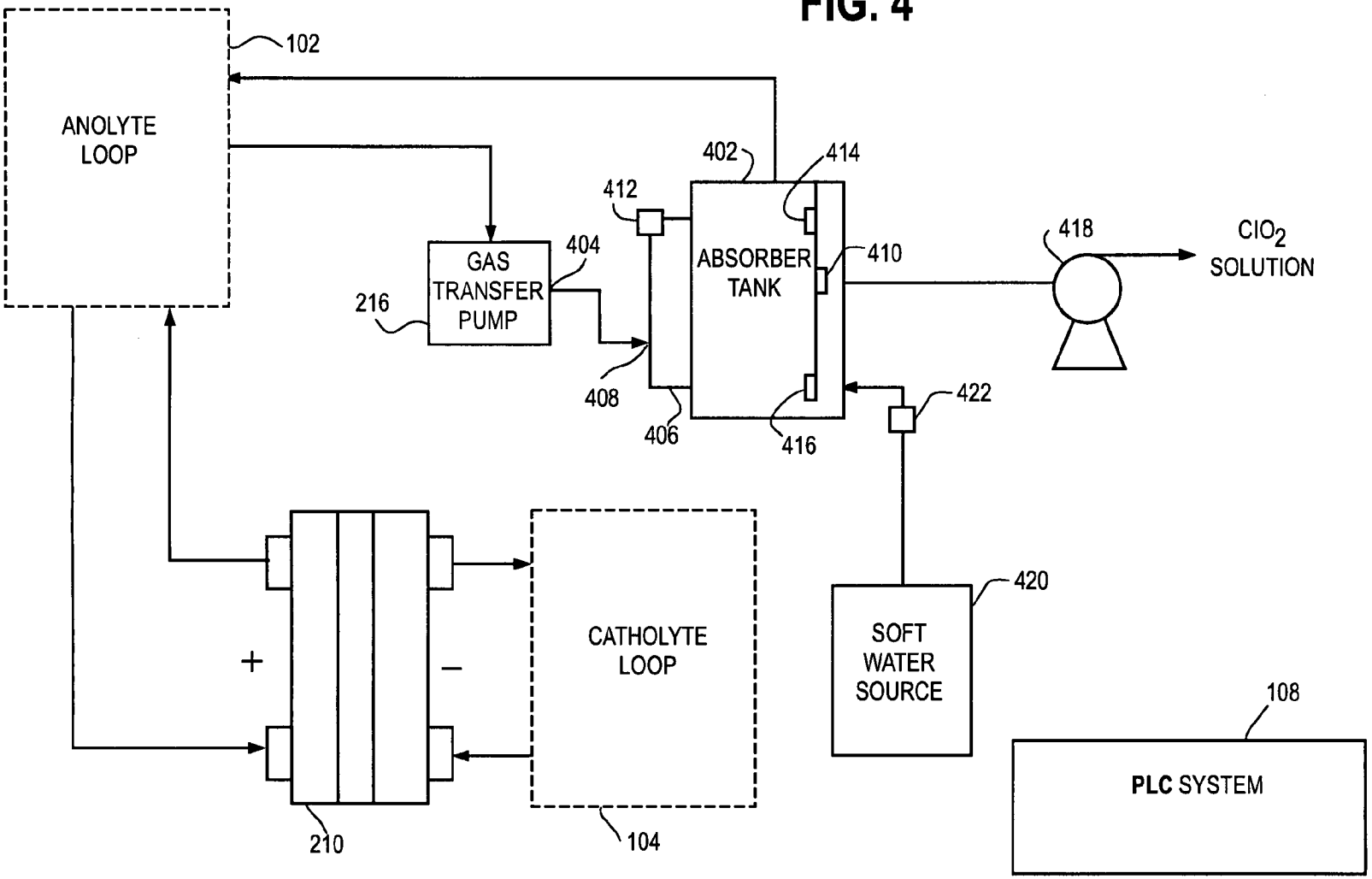
FIG. 4 is a process flow diagram of an absorption loop of an embodiment of the present chlorine dioxide solution generator.

FIG. 4 illustrates an absorption loop 106 of an embodiment of the chlorine dioxide solution generator 100. The absorption loop 106 processes the $ClO_2$ gas from the anolyte loop into a chlorine dioxide solution that is ready to be directed to the water selected for treatment.

The $ClO_2$ gas is removed from the stripper column 208 of the anolyte loop 102 using the gas transfer pump 216. In a preferred embodiment, a gas transfer pump 216 can be used that is "V" rated at 75 Torr (10 kPa) with a discharge rate of 34 liters per minute. The vacuum and delivery rate of the gas transfer pump 216 may vary depending upon the free space in the stripper column 208 and desired delivery rate of chlorine dioxide solution.

The $ClO_2$ gas removed from the stripper column 208 using the gas transfer pump 216 is directed to an absorber tank 402 of absorption loop 106. In a preferred embodiment, the discharge side 404 of the gas transfer pump 216 delivers $ClO_2$ gas into a 0.5 inch (13-mm) PVC injection line 406 external to the absorber tank 402. The injection line 406 is an external bypass for fluid between the lower to the upper portions of the absorption tank 402. A gas injection line can be connected to the injection line 406 using a T-connection 408. Before $ClO_2$ gas is directed to the absorber tank 402, the tank 402 is filled with water to approximately 0.5 inch (13 mm) below a main level control 410. The main level control 410 can be located below where the injection line 406 connects to the upper portion of the absorption tank 402. Introducing $ClO_2$ gas into the injection line 406 can cause a liquid lift that pushes newly absorbed $ClO_2$ solution up past a forward-only flow switch 412 and into the absorber tank 402. The flow switch 412 controls the amount of liquid delivered to the absorber tank 402. The absorber tank 402 has a main control level 410 to maintain a proper tank level. In addition to the main control level, safety control levels can be used to maintain a high level 414 and low level 416 of liquid where the main control level fails. A process delivery pump 418 feeds the $ClO_2$ solution from the absorption tank 402 to the end process without including air or other gases. The process delivery pump 418 is sized to deliver a desired amount of water per minute. The amount of $ClO_2$ gas delivered to the absorber tank 402 is set by the vacuum and delivery rate set by the gas transfer pump 216.

The PLC system 108 can provide a visual interface for the operator to operate the entire chlorine dioxide solution generator 100. The PLC system 108 can automatically control the continuous operation and safety of the production of $ClO_2$ solution. The PLC system can set flow rates for the anolyte and catholyte loops 102, 104. The safety levels of the absorber tank 402 can also be enforced by the PLC system 108. A PLC system 108 can also control the power for achieving a desired current in an embodiment using an electrochemical cell 210. In a preferred embodiment, the current ranges from 0 to 100 amperes, although currents higher than this average are possible. The amount of current determines the amount of $ClO_2$ gas that is produced in the anolyte loop 102. The current of the power supply can be determined by the amount of chlorine dioxide that is to be produced. A PLC system 108 can also be used to monitor the voltage of the electrochemical cell 210. In a preferred embodiment, the electrochemical cell 210 may be shut down when the voltage exceeds a safe voltage level. In another preferred embodiment, 5 volts can be considered a safe voltage level.

Another operation that can be monitored with the PLC system 108 is the temperature of the electrochemical cell 210. If overheating occurs, the PLC system 108 shuts down the electrochemical cell 210.

The PLC system 210 can also monitor the pH of the anolyte using a pH sensor 212. During operation of the electrochemical cell 210, the pH of the solution circulating in the anolyte loop 102 decreases as hydrogen ions are generated. In the exemplary embodiment of the $NaClO_2$ reactant feedstock, when the pH goes below 5, additional reactant feedstock is added using the PLC system. Control of pH can also be handled by adding a reactant that depletes the pH where pH may be too high.

In another embodiment, the transfer line from the gas transfer pump 216 can be connected to the absorber tank 402 directly without the injection line 406, and may allow for increasing the transfer rate of the pump. Other embodiments can include a different method of monitoring the liquid level in the absorber tank 402. For example, an ORP (oxidation and reduction potential) can be dipped in the absorber tank 402. ORP can be used to monitor the concentration of chlorine dioxide in the solution in the absorber tank 402. The PLC system 108 can be used to set a concentration level for the chlorine dioxide as monitored by ORP, which provides an equivalent method of controlling the liquid level in the absorber tank 402. Optical techniques such as photometers can also be used to control the liquid level in the absorber tank 402. The absorption loop can be a part of the chlorine dioxide generator or it can be installed as a separate unit outside of the chlorine dioxide generator. In another embodiment, process water can be fed directly in the absorber tank 402 and treated water can be removed from the absorber tank 402. The process water can include a demineralized, or soft, water source 420 and the process water feed can be controlled using a solenoid valve 422.

The process flow illustrated in FIGS. 1, 2 and 3 are based on $ClO_2$ gas produced using electrochemical cells and a sodium chlorite solution. $ClO_2$ gas can be made using many different processes that would be familiar to a person skilled in water treatment technologies. Such processes include, but are not limited to, acidification of chlorite, oxidation of chlorite by chlorine, oxidation of chlorite by persulfate, use of acetic anhydride on chlorite, use of sodium hypochlorite and sodium chlorite, use of dry chlorine/chlorite, reduction of chlorates by acidification in the presence of oxalic acid, reduction of chlorates by sulfur dioxide, and the ERCO R-2®, R-3®, R-5®, R-8®, R-10® and R-11® processes.

While particular elements, embodiments and applications of the present invention have been shown and described, it will be understood, of course, that the invention is not limited thereto since modifications can be made by those skilled in the art without departing from the scope of the present disclosure, particularly in light of the foregoing teachings.

What is claimed is:

1. A chlorine dioxide solution generator comprising:

(a) an anolyte loop comprising a reactant feedstock stream, at least one electrochemical cell fluidly connected to said feedstock stream, said reactant feedstock stream directed through said at least one electrochemical cell to produce a chlorine dioxide solution, and a stripper column, said chlorine dioxide solution directed from said at least one electrochemical cell into said stripper column, said stripper column producing a substantially pure chlorine dioxide gas stream by a vacuum;

(b) a catholyte loop fluidly connected to said anolyte loop via a common electrochemical component; and (c) an absorption loop, said absorption loop fluidly connected to said stripper column, said absorption loop comprising a gas transfer pump, said gas transfer pump directing said chlorine dioxide gas stream exiting said stripper column to a chlorine dioxide absorber tank, said absorber tank having an upper portion and a lower portion connected by an injection line, said substantially pure chlorine dioxide gas stream entering said injection line and a process water stream entering said injection line, at least some of said substantially pure chlorine dioxide gas absorbing into solution with said process water stream to form a substantially pure chlorine dioxide solution wherein said substantially pure chlorine dioxide solution is neutral in pH and substantially free from reaction byproducts, said substantially pure chlorine dioxide solution entering said absorber tank from said injection line and exiting said absorber tank into a pressurized fluid stream of a fluid to be treated without introducing air into said pressurized fluid stream.

2. The chlorine dioxide solution generator of claim 1 wherein said at least one electrochemical cell has a positive end and a negative end, said chlorine dioxide solution directed from said positive end of said at least one electrochemical cell into said a stripper column, said stripper column producing an excess chlorine dioxide solution, said excess chlorine dioxide solution circulated with said reactant feedstock into said at least one electrochemical cell.

3. The chlorine dioxide solution generator of claim 2 wherein said catholyte loop is fluidly connected to said negative end of said at least one electrochemical cell, said catholyte loop comprising a demineralized water source, said demineralized water source connected to said negative end of said at least one electrochemical cell, said demineralized water source having a positive ionic constituent imparted thereto from a reaction of a reactant feedstock in said at least one electrochemical cell to produce an ionic solution byproduct stream, said ionic solution byproduct stream directed from said negative end of said at least one electrochemical cell to a byproduct tank, said ionic solution byproduct stream circulated with said demineralized water source from said byproduct tank to said at least one electrochemical cell.

4. The chlorine dioxide generator of claim 3 where a residual stream of substantially pure chlorine dioxide gas exits said upper portion of said absorber tank and circulates back into said chlorine dioxide gas generator loop.

5. The chlorine dioxide solution generator of claim 3, wherein said reaction of said reactant feedstock produces a byproduct gas, said byproduct gas directed from said negative end of said at least one electrochemical cell.

6. The chlorine dioxide solution generator of claim 5, wherein said byproduct gas is diluted with ambient air and exhausted from said generator.

7. The chlorine dioxide solution generator of claim 3, wherein said byproduct solution in said byproduct tank is diluted.

8. The chlorine dioxide solution generator of claim 1, wherein said process water is substantially demineralized.

9. The chlorine dioxide solution generator of claim 1, wherein said process water is produced by reverse osmosis.

10. The chlorine dioxide solution generator of claim 1, wherein at least one flow switch in said injection line controls inflow of said process water.

11. The chlorine dioxide solution generator of claim 1, wherein at least one flow switch in said injection line controls gas flow through said absorber.

12. The chlorine dioxide solution generator of claim 1, wherein said reactant feedstock is a sodium chlorite solution having a sodium chlorite concentration of up to the maximum amount capable of being dissolved in said reactant feedstock.

13. The chlorine dioxide solution generator of claim 1, wherein sodium chlorite is present in said reactant feedstock in a concentration between 5 percent and 25 percent by weight.

14. The chlorine dioxide solution generator of claim 1, further comprising a programmable logic control system.

15. The chlorine dioxide generator of claim 1 wherein the pressurized fluid stream is a liquid stream.

16. The chlorine dioxide generator of claim 1 wherein the pressurized fluid stream is a water stream.

17. The chlorine dioxide generator of claim 1 wherein chlorine dioxide gas flow is controlled by applying a set amount of current to the electrochemical component.

18. The chlorine dioxide generator of claim 1 wherein a programmable logic control system is used to control levels of chlorine dioxide solution in the absorber tank.

19. The chlorine dioxide generator of claim 1 where a residual stream of substantially pure chlorine dioxide gas exits said upper portion of said absorber tank and circulates back into said chlorine dioxide gas generator loop.

20. The chlorine dioxide solution generator of claim 1, wherein said chlorine dioxide solution is introduced into a pressurized fluid stream operating at pressures ranging from 1 psi to 100 psi (6.9 kPa to 689 kPa).

21. The chlorine dioxide solution generator of claim 1, wherein said chlorine dioxide solution is introduced into a pressurized fluid stream operating at pressures ranging from 30 psi to 100 psi (206.8 kPa to 689 kPa).

22. The chlorine dioxide solution generator of claim 1, wherein said chlorine dioxide solution is introduced into a pressurized fluid stream operating at pressures ranging from 50 psi to 100 psi (344.7 kPa to 689 kPa).

23. The chlorine dioxide solution generator of claim 1, wherein said chlorine dioxide solution is introduced into a pressurized fluid stream operating at pressures greater than 100 psi (689 kPa).

* * * * *